United States Patent [19]

Tsuzurabara et al.

[11] 4,419,606

[45] Dec. 6, 1983

[54] MAGNETRON

[75] Inventors: Mamoru Tsuzurabara; Seiji Kitakaze, both of Mobara, Japan

[73] Assignee: Hitachi, Ltd., Tokyo, Japan

[21] Appl. No.: 268,905

[22] Filed: Jun. 1, 1981

[30] Foreign Application Priority Data

Jun. 2, 1980 [JP] Japan ..... 55-72768

[51] Int. Cl.[3] ..... H01J 25/50

[52] U.S. Cl. ..... 315/39.51; 315/39.53; 315/39.75; 331/86

[58] Field of Search ..... 315/39.51, 39.53, 39.75; 331/86

[56] References Cited

U.S. PATENT DOCUMENTS

Re. 28,114 8/1974 Anderson et al. ..... 315/39.51

3,846,667 11/1974 Hisada et al. ..... 315/39.53

4,131,824 12/1978 Nakai et al. ..... 315/39.53

*Primary Examiner*—Saxfield Chatmon, Jr.

*Attorney, Agent, or Firm*—Antonelli, Terry & Wands

[57] ABSTRACT

A magnetron has a filter circuit inserted in a feeder line to a cathode electrode included in a high frequency generator and comprised of choke coils and a capacitor connected in series, in order to suppress leakage of unwanted high frequency components from the cathode electrode. At least one of the choke coils has an air-core coarse coil winding close to the cathode electrode which has at least two turns and a remainder of fine coil winding wound about a ferrite core, so that burning of the choke coil and overheating of the ferrite core can readily be prevented without imparing the function to suppress unwanted high frequency component leakage.

11 Claims, 3 Drawing Figures

MAGNETRON

BACKGROUND OF THE INVENTION

1. Field of the Invention

This invention relates to magnetrons of the type wherein choke coils for suppressing leakage of unwanted high frequency components can be prevented from overheating.

2. Description of the Prior Art

In magnetrons widely used for, for example, electronic ovens, leakage of unwanted high frequency components such as harmonics interferes with, for example, TV reception and is sometimes damaging to living creatures. To suppress such a leakage, it is common practice to use a magnetron of the type wherein a filter circuit comprised of a series connection of choke coils and a through-hole type capacitor is connected in a power feeder line of a cathode filament and housed by a hermetic shield case.

Exemplified in sectional form in FIG. 1 is a magnetron provided with the filter circuit which comprises an anode structure having a cylindrical anode electrode 1 and a plurality of vanes 2 mounted to the inner wall of the anode electrode. An interaction space 3 is formed between the plurality of vanes 2 and a cathode electrode 4 disposed concentrically with the anode electrode. Magnetic pole pieces 61 and 62 mounted to opposite ends of the anode electrode 1 serve to guide magnetic flux fed from a permanent magnet 63 by way of a yoke 6 to the interaction space 3.

An output terminal 5 opposes one end of the anode structure through a metal member 51 and an insulating member 52. Cathode input terminals 7 and 7' extend from a pair of lower and upper end caps 53' and 53 for supporting the cathode electrode 4 in the opposite direction to the output terminal 5 and pass through a metal tube 71 and a cathode stem insulating member 72. Coils 15 and 15' are connected in series with a capacitor 16 to form a filter circuit 8 to which lead wires 9 and 9' are connected which extend exteriorly of a shield case 10 adapted to house the filter circuit. The shield case 10 has a bottom **10*a* sealingly mated with an opening of the yoke 6 and an upper opening 10*b* covered with a lid 11 firmly secured to the case 10 by the aid of blind rivets 12. The coils 15 and 15' are wound about high frequency absorbers 17 and 17' and fixed thereto by an adhesive 18**.

FIG. 2 shows the interior of the shield case of a conventional magnetron with the lid removed. In the figure the same elements as those in FIG. 1 are designated by the same reference numerals. Shown therein are cathode input terminals 7 and 7', choke coils 15 and 15', through-hole type capacitor 16, shield case 10, rod shaped ferrite cores 17 and 17' serving as high frequency absorbers, and coils 15 and 15' having coil windings 22 and 22'.

In operation of the magnetron, high frequency energy is generated in the interaction space 3 as defined by the vanes 2 and reaches the output terminal 5 for propagation to an electronic oven via a wave guide tube not shown. However, the high frequency partly reaches the cathode electrode 4 and leaks, via the cathode input terminals 7 and 7', to the coils 15 and 15' and high frequency absorbers 17 and 17' constituting the filter circuit 8. Such a leakage is especially aggravated when the electronic oven is operated without an object to be heated. As well known in the art, the size of the choke coil for a given inductance can be reduced by inserting a high permeability core in the coil. A ferrite core is desirably used with the magnetron choke coil because of its versatility in performance. Specifically, a large high frequency power loss is caused in ferrite placed in a high frequency electromagnetic field and as a result the intensity of the electromagnetic field is greatly attenuated. In other words, the ferrite core inserted in the choke coil effectively acts as a high frequency absorber which can effectively prevent the leakage of high frequency. But the ferrite core is in turn heated to a high temperature with the result that a high voltage develops across adjacent coil windings of the coil wound about the ferrite core. Consequently, there were encountered in the conventional magnetron problems that the covers of coil windings of the choke coil close to the cathode input terminal are burnt and the ferrite core is deteriorated or cracked owing to heat at high temperatures. Disclosed in Japanese Utility Model Kokai (Laid-Open) No. 58944/77 (laid open Apr. 28, 1977) assigned to the same assignee as the present application is an expedient to solve this problem, according to which a choke coil has in part air-core coil windings close to the cathode input terminal. More particularly, the choke coil according to this expedient has, as shown in FIG. 2, 12 turns in total and 4 turns close to the cathode input terminal 7 or 7' are deprived of the ferrite core 17 or 17'. This expedient alleviates the problem but is not so effective as to fulfil its intended effect for a variety of magnetrons of different specifications. An essentially similar expedient to the above has been proposed in Japanese Patent Kokai (Laid-Open) No. 37348/78 (laid open Apr. 6, 1978). What is different from the former proposal resides in that two partial air-core coil windings have different inductances. Specifically, one air-core coil winding of the coil 15 connected to one (7) of the two cathode input terminals 7 and 7' which is coupled with the center lead for cathode support has a smaller number of turns than the other air-core coil winding of the coil 15'. With this latter expedient, however, the inventors have experienced certain experimental results which are inferior to those obtained with the former. Japanese Utility Model Kokai (Laid-Open) No. 101962/79 discloses another proposal in which the ferrite core is applied only to a central coil winding of the choke coil, forming air-core coil windings at opposite ends. However, one air-core coil winding of this expedient close to the cathode input terminal simulating the aforementioned Japanese Utility Model Kokai (Laid-Open) No. 58944/77 is not always fully effective and the other air-core coil winding close to the capacitor, which is not essentially subject to high temperature rise, does not play an important role. Nevertheless, the total length of the choke coil according to this proposal is sometimes required to be prolonged in order to prevent high frequency leakage to the same extent as the present invention. Japanese Utility Model Kokai (Laid-Open) No. 42458/79 (laid open Mar. 22, 1979) discloses still another proposal in which at least one of the paired choke coils has a prolonged end wiring, making a detour merging into the cathode input terminal. However, the detouring end wiring tends to contact the shield case and it is practically impossible to make so long a detour of the end wiring as to attain sufficient effects without enlarging the shield case in view of the electrical insulation because the end wiring to the cathode electrode is at a high negative potential relative to the shield case at earth potential.

SUMMARY OF THE INVENTION

An object of the present invention is to provide a magnetron wherein its choke coils can be freed from the conventional disadvantages and prevented from overheating without impairing compatibility with mass production.

According to the present invention, the above object can be accomplished by a magnetron comprising a pair of choke coils at least one of which has an air-core coil winding of at least 2 turns close to the cathode electrode which is so coarse as to establish a spacing sufficient to separate covers of adjacent turns, and a remainder of coil winding wound about a ferrite core which is so fine that covers of adjacent turns are in intimate contact. The choke coil of this construction can have a relatively small size to provide a sufficient inductance. In the case of magnetrons incorporating the present invention which are mass produced mainly for application to electronic ovens, the choke coil has almost standard design factors. However, a great number of trials and experiments conducted by the inventors of the present invention for the purpose of improving prevention capability against overheating and burning have led to the provision of an air-core coarse coil winding between a substantially straight lead wire directly coupled with the cathode input terminal and a fine coil winding wound about a ferrite core. It was found that the air-core and coarse coil winding is protected from dielectric breakdown between its adjacent turns and burning of its insulating cover even when placed in a highly intensive electromagnetic field generated by reflection wave and attendant stationary wave due to rapid change of the line impedance, and that the air-core coarse coil winding of 2 to 10 turns, preferably 2 to 5 turns, reflects and radiates the leakage of high frequency component which would reach the ferrite core fine coil winding, so that the high frequency component is attenuated to such an extent that the ferrite core can be freed from overheating. Experiments also showed that the spacing between insulating covers of adjacent turns of the coarse coil winding can be half the diameter of coil wire at the most (about 1 mm for a 2 mm diameter wire). Thus, the number of turns of the coarse coil winding which is 2 or more, 10 at the most, and the spacing of the above order makes it possible to provide a choke coil of a length which is slightly longer than that of the conventional choke coil, thereby eliminating the necessity of enlarging the shield case.

DESCRIPTION OF THE PREFERRED EMBODIMENT

Figure 1:
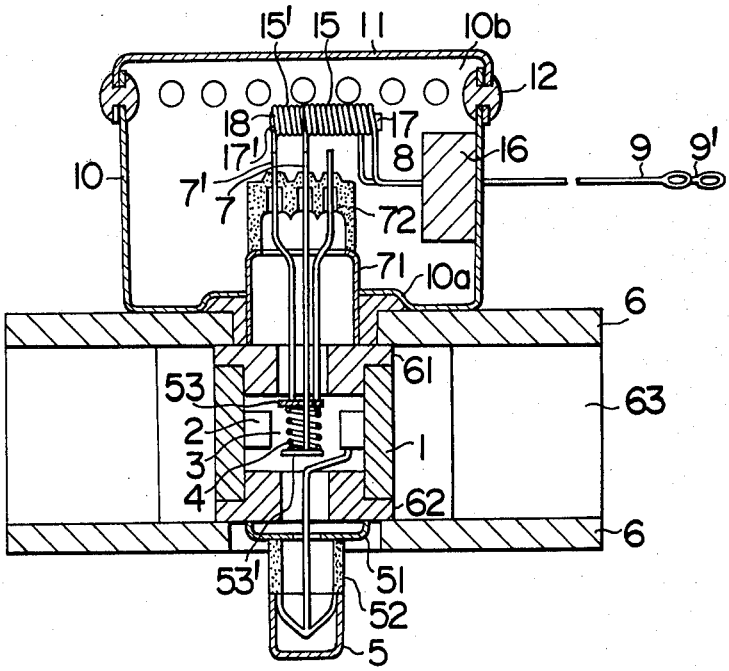
FIG. 1 is a sectional view showing one example of a magnetron having a filter circuit housed by a shield case 1.
Figure 2:
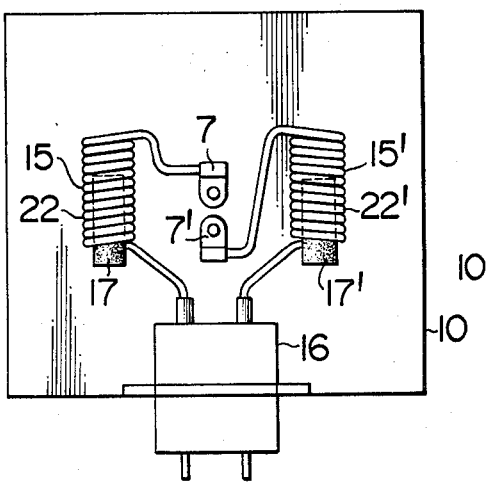
FIG. 2 is a plan view showing the interior of a shield case of a conventional magnetron.
Figure 3:
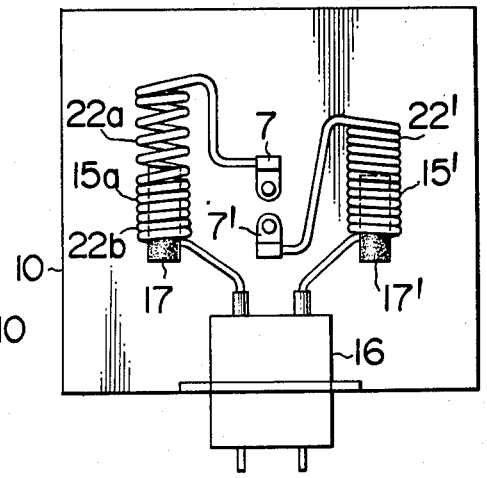
FIG. 3 is a plan view showing the interior of a shield case of a magnetron according to the present invention.

FIG. 3 shows the interior of a shield case 10 of a magnetron embodying the invention. In the figure, the same elements as those of FIG. 2 are designated by the same reference numerals. A choke coil 15*a* in accordance with teachings of the present invention comprises an air-core coarse coil winding 22*a* and a fine coil winding 22*b* wound about a ferrite core 17. It will be appreciated that in this embodiment, only one (15*a*) of a pair of choke coils 15*a* and 15' connected to the center lead 7 has the coarse coil winding 22*a*. This is because the intensity of high frequency component propagating along the center lead 7, which supports the cathode filament 4 at the cap 53' remote from the cathode stem 72 as shown in FIG. 1, is relatively large. Thus, the other choke coil 15' has an air-core fine coil winding close to the cathode input terminal 7', like the conventional choke coil of the uniform fine coil winding. As an alternative, both the choke coils may have coarse coil windings close to the cathode input terminals. Either a single coarse coil winding type or a double coarse coil winding type may be selected in consideration of requirements for manufacture and construction. Of two choke coils of the same turns, one having the air-core coarse coil winding has a slightly smaller inductance than the other having the air-core fine coil winding. Actually, however, this difference is negligible and there is no need of making greater the number of turns of the fine coil winding wound about the ferrite core than that of the conventional choke coil.

As has been described, the present invention can easily prevent burning of the choke coil and overheating of the ferrite core without impairing the function to suppress unwanted high frequency energy leakage in the magnetron, and can improve reliability of the magnetron.

We claim:

1. A magnetron comprising:

an anode structure having a cylindrical anode electrode and vanes interiorly of the anode electrode;

a cathode electrode disposed concentrically with the anode structure;

cathode input terminals connected to the cathode electrode and extending from interior to exterior of the anode structure; and a shield case housing a filter circuit comprised of choke coils and a capacitor connected in series with the cathode input terminals, at least one of said choke coils having an air-core coil winding of at least two turns close to one of said cathode input terminals, the at least two turns of the air-core coil winding being wound at a predetermined spacing therebetween and a remainder of the at least one choke coil being wound about a ferrite core with adjacent turns thereof being wound in intimate contact.

2. A magnetron according to claim 1 wherein, the predetermined spacing between the turns of the air-core coil winding is half the diameter of the coil wire at the most.

3. A magnetron according to claim 1 wherein one choke coil connected to a center lead for support of the cathode electrode has the air-core coil winding close to the cathode input terminal of at least two turns wound at the predetermined spacing.

4. A magnetron according to claim 1 or 3, wherein the number of turns of the air-core coil winding wound at the predetermined spacing is 2 to 5.

5. A magnetron according to claim 3, wherein the predetermined spacing between the turns of the air-core coil winding of the choke coil connected to the center lead is half the diameter of the coil wire at the most.

6. A magnetron according to claim 3, wherein two choke coils are provided, the other choke coil being connected to a side lead of the cathode electrode, the other choke coil being a coil winding with adjacent turns in intimate contact.

7. A magnetron for generating microwave including concentric cathode and anode structures and a magnet for applying a magnetic field in a space between the cathode and the anode structure, comprising:

the cathode structure having a central lead and a side lead; and a filter circuit accommodated in a shield case and including a first and a second series circuit, each including a choke coil and a capacitor, connected to the central lead and to the side lead, respectively, the choke coil of the first series circuit including a coarse coreless coil winding with spaced turns connected to said central lead and a dense core coil winding connected between said coarse coreless coil winding and the capacitor, the coarse coil winding having a larger pitch than the dense coil winding.

8. A magnetron according to claim 7, wherein the choke coil of the second series circuit comprises only a dense coil winding of a pitch smaller than that of the coarse coil winding of the first series circuit.

9. A magnetron according to claim 8, wherein the said dense coil winding of the first circuit is provided with a ferrite core, adjacent turns of the dense coil winding of the first series circuit being wound in intimate contact.

10. A magnetron according to claim 8, wherein the coarse and dense windings of the first and second series circuits have respective uniform pitches.

11. A magnetron according to claim 9, wherein the dense coil winding of the second series circuit includes a portion provided with a ferrite core, adjacent turns of the second series circuit being wound in intimate contact.

* * * * *